United States Patent [19]

Paepke

[11] 3,990,270

[45] Nov. 9, 1976

[54] KNITTING MACHINE

[75] Inventor: Horst Paepke, Rottenburg am Neckar, Germany

[73] Assignee: Hayes-Albion Corporation, Norristown, Pa.

[22] Filed: Aug. 28, 1974

[21] Appl. No.: 501,162

Related U.S. Application Data

[60] Continuation of Ser. No. 303,546, Nov. 3, 1972, abandoned, which is a division of Ser. No. 150,052, June 4, 1971, Pat. No. 3,742,733, which is a continuation-in-part of Ser. No. 824,227, May 13, 1969, abandoned.

[52] U.S. Cl. ..... 66/50 R; 66/50 B

[51] Int. Cl.[2] ..... D04B 15/78

[58] Field of Search ..... 66/50 R, 50 B, 75, 25, 66/154 A; 334/249

[56] References Cited

UNITED STATES PATENTS

| | | | |
|---|---|---|---|
| 2,129,148 | 9/1938 | Page | 66/25 |
| 3,461,690 | 8/1969 | Martinetz et al. | 66/50 R |
| 3,530,686 | 9/1970 | Martinetz | 66/50 R |
| 3,534,566 | 10/1970 | Farmer et al. | 66/50 R |
| 3,609,609 | 9/1971 | Bertazzi | 335/249 |

FOREIGN PATENTS OR APPLICATIONS

| | | | |
|---|---|---|---|
| 1,113,296 | 5/1968 | United Kingdom | 66/50 B |

*Primary Examiner*—Wm. Carter Reynolds
*Attorney, Agent, or Firm*—Robert B. Frailey

[57] ABSTRACT

A circular knitting machine comprises a rotatable knitting needle cylinder which carries a plurality of knitting needles through knitting stations. A needle-moving jack is pivotally connected with each of the knitting needles and is movable in a needle-raising stroke and a needle-lowering stroke to effect needle raising and lowering, respectively. Each of the needle-moving jacks has a butt thereon which is received in a cam track which operates to effect the raising and lowering of the needle-moving jack. A mechanism is provided for controlling the operation of each knitting needle as it progresses through the stations. The mechanism specifically effects pivoting of the needle-moving jack so that the butt thereon is removed from the cam track. The means which effects the pivoting movement of each needle-moving jack comprises a movable selector jack which cooperates with the needle-moving jack and effects the pivoting movement of the needle-moving jack in response to actuation of electromagnetic means. The electromagnetic means controls the movement of each selector jack so that a selector jack is moved to effect the pivoting movement of the needle-moving jack or not moved to allow the needle-moving jack with which it is associated to remain with its butt in the cam track.

5 Claims, 14 Drawing Figures

17
15
16
18
21
19
20
25
30
79b
95
31
92
52a
90
15a
79a
52
51
93
50
81
53
76
80
75
60
82
70
56
57
85
85a
57b
54
55
55a
32
79

KNITTING MACHINE

This application is a continuation of co-pending application Ser. No. 303,546, filed Nov. 3, 1972, now abandoned. Application Ser. No. 303,546 is a division of application Ser. No. 150,052, filed June 4, 1971, now U.S. Pat. No. 3,742,733. Application Ser. No. 150,052 was a continuation-in-part of application Ser. No. 824,227, filed May 13, 1969, now abandoned.

The present invention relates to a circular knitting machine having a plurality of knitting stations through which knitting needles are sequentially advanced and which includes mechanism for selectively controlling the operation of the needles at the knitting stations.

Known circular knitting machines include mechanism for selectively controlling the operation of the knitting needles. Numerous patents disclose and describe circular knitting machines which include a mechanism for selectively controlling the needle operation at each of the knitting stations. By these mechanisms the knitting needle may be controlled to either knit, welt, or tuck, as is well known. Known designs of knitting machines, of this type, have been directed to the problems of providing accurate, rapid selection of the respective needles and high-speed operation of the machine with a minimum possibility of breakdown due to breaking of the needles or butts on the needles.

The principal object of the present invention is to provide a new and improved circular knitting machine which includes a mechanism for selectively controlling the operation of the needles and which provides for extremely accurate selection of the needles and minimizes the possibility of the machine jamming due to breakage of the needles or the needle-actuating jacks, and enabling the knitting machine to operate at extremely high speeds.

The above general objects are achieved by a unique machine design embodying the present invention. In particular, the unique design includes a needle-moving jack pivotally connected with each knitting needle. Each needle-moving jack is movable in a needle-raising stroke and a needle-lowering stroke to effect needle raising and lowering. Each needle-moving jack has at least one butt thereon which is received in a cam track. The cam track has a needle-raising portion which operates on the butts to raise the associated needle-moving jack as the jacks move therethrough to thereby raise the needle associated therewith, and a needle-lowering portion which operates on the butts to lower the associated needle-moving jack to thereby lower the needle associated therewith. Each needle-moving jack has a selector jack associated with it and when the selector jack moves, it effects pivoting of the needle-moving jack to move the butt thereof out of the cam track. A plurality of electromagnetic actuators operate on the selector jacks to effect movement thereof which results in the pivoting of the needle-raising jack.

Accordingly, a more specific object of the present invention is the provision of a new and improved circular knitting machine having a needle-moving jack pivotally connected with each knitting needle and pivotal relative thereto to control movement of the needle, and selector jack associated with each needle-moving jack and movable radially of the needle cylinder to effect pivoting of the needle-moving jack and the movement of which is controlled by electromagnetic means.

A further object of the present invention is the provision of a new and improved knitting machine having a needle-moving jack pivotally connected with each knitting needle and pivotal relative thereto to control movement of the needle and a plurality of electromagnetic actuators at each knitting station to control the pivoting movement of the needle-moving jacks.

A still further object of the present invention is the provision of a new and improved knitting machine, as noted above, wherein a selector jack is associated with each needle-moving jack and is movable to effect pivoting of the needle-moving jack and a series of selector jacks have butts thereon at different locations and the electromagnetic actuators are located so as to actuate movement of only one of the selector jacks in the series.

Another object of the present invention is the provision of a new and improved knitting machine, as noted above, wherein the selector jacks are engaged by surfaces at each knitting station which control the movement of the selector jacks and prevent wobbling and vibrating thereof.

Still further objects, advantages and novel features of the present invention will be apparent to those skilled in the art to which it relates from the following detailed description of preferred embodiments thereof made with reference to the accompanying drawings and in which.

The present invention provides a new and improved circular knitting machine which includes means for selectively controlling the operation of the knitting needles at each of the knitting stations as the knitting needles advance through the stations. The present invention is directed primarily to the provision of a high-speed knitting machine in which there is a minimum chance of breaking the butts of needles and the control or selection of the knitting needles can be made accurately and rapidly.

Figure 1:
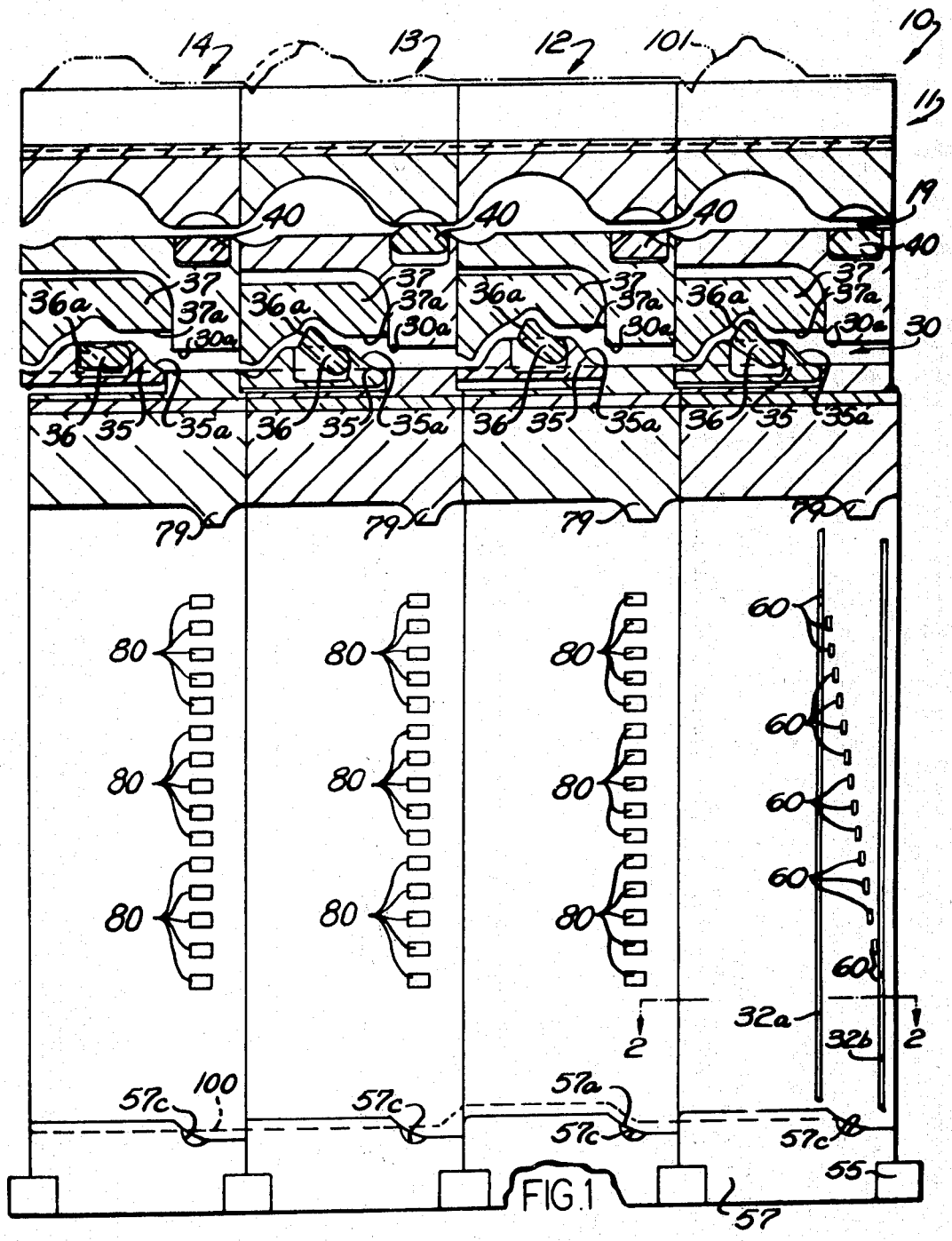
FIG. 1 is a schematic representation of a circular knitting machine.

Referring to FIG. 1, a portion of a circular knitting machine, generally designated 10, is illustrated. The portion illustrated is shown in plan view and is somewhat schematic. The portion of the knitting machine 10, illustrated in FIG. 1, comprises four knitting stations, generally designated 11, 12 13 and 14, which are located in sequence around a portion of the knitting machine and through which the knitting needles are advanced in succession. The knitting stations 11, 12, 13 and 14 are located around a circular knitting needle-carrying cylinder 15. The needle-carrying cylinder 15 is suitably driven or rotated about the axis thereof in any conventional or suitable manner. The needle-carrying cylinder 15 includes a plurality of vertically extending slots 16 in which the knitting needles 17 are carried. The knitting needles 17 each have a butt 18 thereon. The butts 18 of the needles 17 move through a cam track or path 19, illustrated in FIG. 1.

Each needle 17 has a needle-moving jack 20 associated therewith. The needle-moving jack 20 is pivotally connected at its outer end 21 to its associated knitting needle 17. Each needle-moving jack 20 has a butt 25 thereon which is located intermediate the ends of the jack. The butt 25 of the needle-moving jack moves in a cam track 30, as shown in FIG. 1.

Each of the needle-moving jacks 20 has a needle selector jack 32 associated with it and which is operable to effect pivoting movement of the needle-raising jack 20 so as to remove the butt 25 thereof from the cam track 30 upon movement of the selector jack 32, as will be described in detail hereinbelow. If the butt 25 of a needle-moving jack 20 is removed from the cam track 30 as the jack 20 moves into a knitting station, the knitting needle 17 associated with the jack 20 will move through that particular station without being raised by the jack 20. In the event, however, that the selector jack 32 is not operated to effect the pivotal movement of the knitting needle-moving jack 20, the butt 25 thereof will remain in the cam track 30 and thereby the knitting needle will be moved in a vertical direction to effect a knitting operation.

More specifically, the cam track 30 is defined by a plurality of cams which act upon the butt 25 to effect the raising and lowering movement of the needle-moving jack 20. In this connection each knitting station has a plurality of cams, designated 35, 36 and 37, located thereat. The cam 37 may be termed a stitch cam and has a surface 37*a* which defines the upper portion of the cam track 30. The cam 35 has a surface 35*a* which defines a lower surface portion of the cam track 30. The cam 36 is the tuck cam and is a movable cam or an adjustable cam which is suitably supported within the cam 35 and has a surface 36*a* which defines a portion of the cam track 30.

The cams 35–37 are all adjustably supported for vertical movement in a suitable manner which will not be described herein in detail. It should be apparent, however, that by adjusting the cams 35, 36 and 37, in various positions, the movement of the needle-moving jack 20 can be controlled and thereby the amount of movement of the knitting needle 17 can be controlled. As illustrated in FIG. 1, the cams at knitting stations 11, 12 and 13 are located in order to effect a knitting operation by the knitting needle in the event that the butt 25 on the needle-moving jack 20 is allowed to remain in the cam track 30. The cams at station 14 are positioned so as to enable the knitting needle 17 to move to a tuck position due to the fact that the tuck cam 36 is not in a raised position, but rather is retained in the retracted illustrated position, as is well known.

Figures 3, 4, 5:
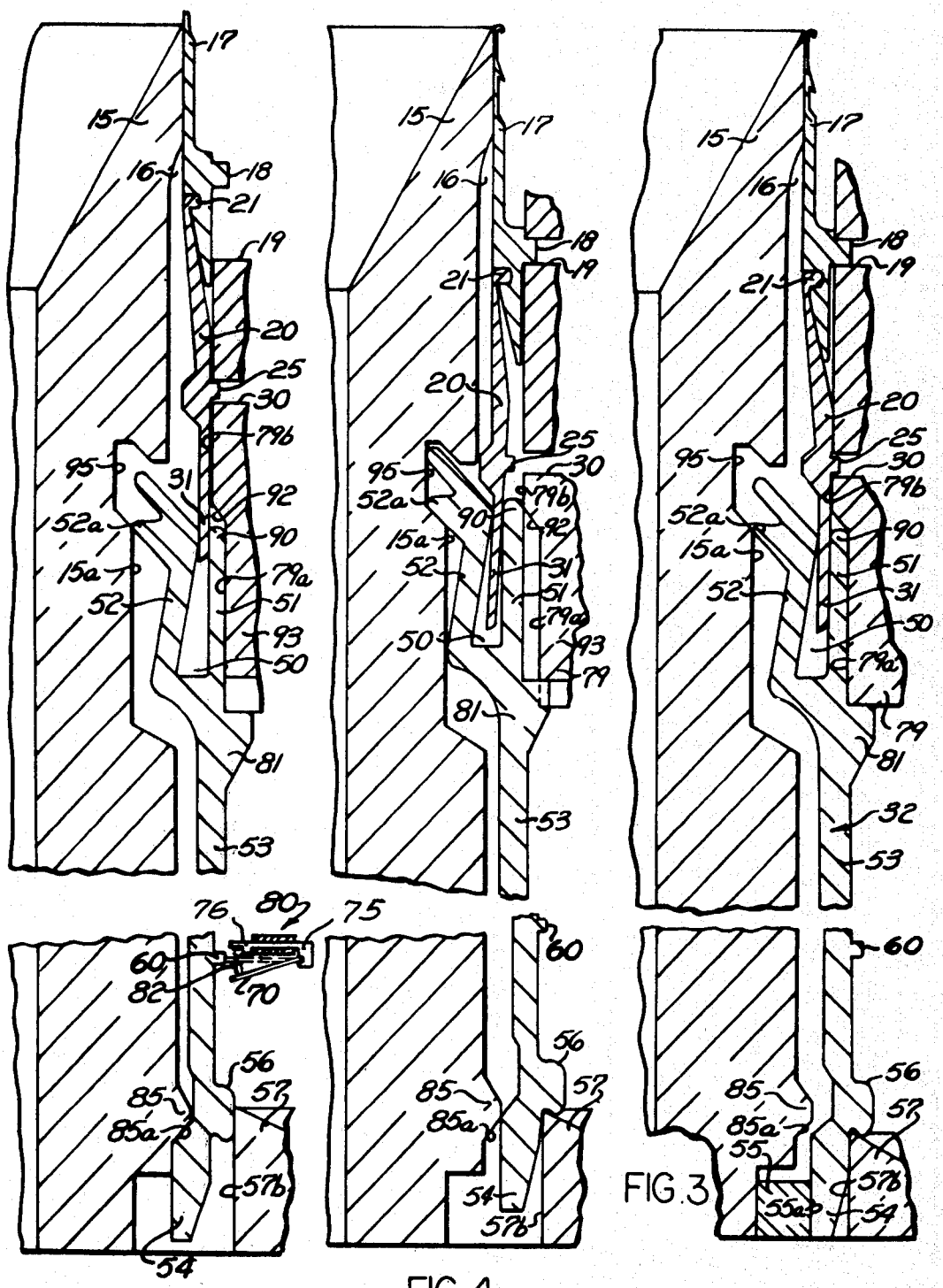
FIGS. 3, 4 and 5 are sectional views illustrating different operative positions of parts of the knitting machine of FIG. 1.

It should be apparent that as the knitting needles 17 and needle-moving jacks 20 are advanced through stations 11-14, if the associated needle-moving jack 20 is in its position, illustrated in FIG. 5 in which the butt 25 on the jack is located in the cam track 30, the needles will at each successive station 11, 12, 13 be raised to effect knitting of the material at that station. The needles, however, at station 14, will be raised to a lesser extent to effect tucking of the material. The needle cam track 19, as is apparent from the drawings, is widened in certain areas so that the butt 18 on the needles 17 will not interfere with the movement of the needle by the knitting needle-moving jack 20. Morever, in the event that the needle-moving jack 20 or selector jack 32 associated with a needle breaks or otherwise malfunctions, the cam track 19 will operate to lower the knitting needle 17 associated therewith if the needle is in a raised position.

At the beginning of each knitting station, a press-on cam 40 is provided and defines a portion of the cam track 19. The press-on cam 40 is adjustable to effect vertical movement of the knitting needles and acts on the butts 18 thereof. When the needle butts 18 are adjacent the press-on cam 40, the butts 25 of the needle-moving jacks 20 are in portion 30*a* of the cam track 30. The portion 30*a* of the cam track 30 is wider than the butt 25 on the needle-moving jack 20. Accordingly, the movement of the knitting needle 17 by the press-on cam 40 is not prevented by the butt 25 on the needle-moving jack 20, and the jack 20 moves with the needle. The press-on cam 40, as is known, facilitates operation of dial needles, not shown, and, more specifically operates when knitting a tight fabric, to hold back the dial stitch.

As noted above, the knitting needles 17 may be controlled at each station so as to welt (not knit) or move either to tuck or knit the material. This is achieved by merely moving or pivoting the needle-moving jack butt 25 out of the cam track 30 at the station so that the corresponding needle will not be raised thereby. This is effected by movement of the selector jacks 32.

The selector jacks 32 which are associated with each of the needle-moving jacks 20 are elongated members having an upper end which defines a slot 50 in which the lower end 31 of the needle-moving jacks 20 are slidably received. The slot 50 is defined by a projecting portion 51 which is located radially outwardly of a projecting portion 52 which is located radially inwardly of the needle-raising jack 20. The selector jacks 32 include a central portion 53 which terminates in an end portion 54. Each of the selector jacks includes a butt 56 on the lower end thereof. The lower end 54 of the selector jacks 32 cooperate with a cam member 55 which effects radial movement of the lower end thereof, and the butts 56 of the selector jacks 32 cooperate with a raising cam 57 at each knitting station, as will be described in greater detail hereinbelow.

The selector jacks 32 are arranged in successive series with fifteen consecutive selector jacks in each series. Each selector jack in the fifteen has an operating butt 60 located thereon. The butts 60 on the consecutive selector jacks 32 of the fifteen are in a vertical staggered relationship with respect to each other. This staggered relationship of the butts 60 on the respective selector jacks 32 is best illustrated in FIG. 1. FIG. 1 illustrates schematically the first selector jack 32*a* of a series of fifteen and the last selector jack 32*b* of the series of fifteen. The butts 60 on the selector jacks 32 are also illustrated schematically, and it should be apparent that the butts 60 are located in a staggered relation, that is, that the butts on each successive selector jack 32 is at a different vertical level than the butt on the adjacent selector jack.

A suitable electromagnetic mechanism or assembly is utilized in association with the selector jacks 32 to control the position of the selector jacks 32 such that either the butt 56 thereon engages the cam 57 and is raised thereby, or the butt 56 thereon will not engage the cam 57 and, therefore, will not be raised thereby. The electromagnetic mechanism or assembly comprises a vertical series of individual electromagnetic mechanisms at each station, each individual mechanism having an electromagnetic coil generally designated 80. The coils or actuators 80 are all arranged in a single vertical column at each station and there are fifteen in number, which equals the number of selector jacks 32 in a series. The coils 80 are illustrated in FIG. 1 schematically for station 12 only. Each of the coils has substantially flat cam member or armature 70 pivotally associated with it. Upon energization of the coil 80, the cam member 70 pivots vertically upwardly about a horizontal pivotal axis against the bias of a spring 82. The coils 80 and associated cam members or armatures 70 are located so that when a coil is energized, the cam member 70 associated therewith moves into the path of movement of a butt 60 on a selector jack 32 and so that its distal end effects radial movement of the selector jack 32 as the selector jack 32 moves therepast. Each cam member 70 acts on a different selector jack 32, as should be apparent from FIG. 1. Each of the coils 80 has a horizontal central axis and is disposed in fixed position on a frame 75. A horizontal core or support portion 76 of the frame 76 extends through the coil 80 and has a central axis which is coincident with the horizontal central axis of the coil. The cam member 70 is connected with the frame 75 for pivotal movement about a horizontal axis. The cam member 70 moves about the horizontal axis from a lowered or inactive position, shown in solid lines in FIG. 5, and an active or raised position, shown in dashed lines in FIG. 5, to effect movement of butt 60 of a selector jack 32. The horizontal central axes of the several coils, cores and armatures in each electromagnetic assembly are all disposed in a single vertical plane. Each spring 82 of each individual electromagnetic mechanism comprises a vertical coil spring supported by and extending downward from the distal end of the horizontal portion 76 of the frame 75 to the distal end of the armature 70, and biases the armature downward to its inactive position. When the member or armature 70 is in inactive position, the spring 82 is disposed intermediate of, i.e., spans the gap between, the armature and the coil 76.

The vertically staggered arrangement of the butts 60 on the selector jacks 32 and the corresponding vertical arrangement of the coils provide sufficient time for the energization of a given coil 80 and de-energization thereof. More specifically, since each coil controls, in the present embodiment, every fifteenth selector jack 32, there is at time interval approximately equal to the time interval for fifteen selector jacks to pass a given point within which a coil can be energized and de-energized. This time interval can be varied by varying the number of selector jacks in a series.

As noted hereinabove, each of the stations 11, 12, 13 and 14 includes an electromagnetic mechanism for effecting movement of the selector jacks 32 to control the operation of the needles 17 as the needles move through the station. The electromagnetic mechanisms are located at the beginning of each station, as shown with respect to station 12.

Figure 2:
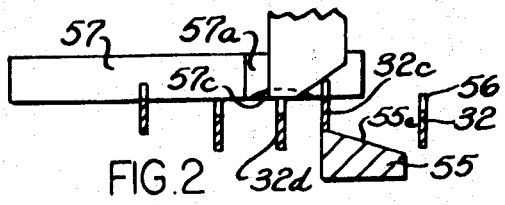
FIG. 2 is a view taken approximately along the line 2-2 of FIG. 1.

As the needles 17 and selector jacks 32 enter a particular station the selector jacks 32 may be in any one of two radial positions depending upon whether the needles associated with the selector jack 32 performed a knitting or a welting operation in the previous station. As a selector jack 32 moves into a station, such as knitting station 11, the selector jack encounters the cam 55 first, as best shown in FIG. 2. The cam 55 has a cam surface **55*a* thereon which engages the lower radially inner edge of the selector jack has, in the previous station, been moved so as not to effect raising of a knitting needle therein. In that event, the selector jack 32 is cammed radially by the cam surface 55*a* into a position, such as indicated at 32*c* in FIG. 2. If the selector jack in the previous knitting station had been in a position so as to effect knitting by a needle associated therewith, the jack would not engage the cam surface 55*a*. However, the selector jack 32 would still arrive at the position 32*c*. Therefore, the cam 55 comprises a means for ensuring that each selector jack as it enters the knitting station takes a position, namely, position 32*c*, in which the selector jack 32** can be selected to either effect a knitting or nonknitting of the associated knitting needle in the knitting station.

As a selector jack 32 is being moved radially by the cam surface **55*a* so that it achieves position 32*c* for selection, the selector jack is also being moved downwardly by a take-down cam 79 which engages a take-down butt 81 on the selector jack. The butt 81 is located on the selector jack 32 adjacent the member 51. As a result, the selector jack 32 as it enters the station 11, immediately prior to selection thereof, achieves the position illustrated in FIG. 3 in which it is securely trapped with the butt 81 in engagement with the cam 79 and the butt 56 thereon in engagement with the raising cam 57. The lower end 54 of the selector jack engages or is trapped between the inner surface 57*b* of the cam 57 and the cam surface 55*a* of the cam 55. The upper end of the selector jack is also trapped between surface 79*a* of the cam 79 and surface 15*a* on the cylinder 15. More specifically, portions 51 and tip 52*a* of portion 52 of the selector jacks engage surfaces 79*a*, 15*a*, respectively. In this manner, the selector jack 32** is retained in a fixed position and is free from the possibility of any wobble or looseness and is maintained under complete control.

If the needle associated with the selector jack 32 which is now located in the selecting position **32*c* is to knit, the electromagnetic coil 80, which is associated with the jack 32, that is, located adjacent to the butt 60 on the selector 32, is energized. When energized, the cam or armature 70 associated with the coil 80 is moved into the path of movement of the butt 60 on the selector jack 32. As a result, the cam 70 effects camming of the selector jack 32 radially into a position 32*d* (FIG. 2) as the selector jack 32 continues to move. When in position 32*d*, the butt 56 on the selector jack 32 is disposed radially inwardly of the raising cam 57, as shown in FIG. 5. As a result, the raising cam 57 effects no action on the selector jack 32 and the selector jack is not moved thereby. Accordingly, the needle-moving jack 20 is not affected and the butt 25 on the needle-moving jack 20 remains in the cam track 30 and the needle-moving jack 20 will effect raising and lowering movement of the needle 17 under the control of the cams defining the cam track 30.**

The radially inner surface of the cam 57 has a cutout **57*c* therein adjacent to where the selector jacks 32 are radially moved. This cutout enables the selector jack 32 to be moved or positioned radially, even if the cam 70 is for some reason ineffective to move the selector jack 32 completely off the cam 57. The cutout 57*c*** operates to receive the tip of the selector jacks 32 and cams them radially inwardly in the event that the cam 70 is ineffective in this respect.

If the selector jack 32 is moved to position 32*d*, so that knitting occurs by the needle 17 associated therewith, the selector jack 32 is still maintained under close control, as shown in FIG. 5. The selector jack 32, as shown in FIG. 5, is trapped between a lug 85 on the needle cylinder 15 and the butt 56 engages the surface 57*b* of the cam 57, thereby preventing any radial movement of the lower end of the selector jack. The upper end of the selector jack is also trapped with portions 51, 52 thereof engaging surfaces 79*a*, 15*a*, as discussed above. Also, since the lug 85 has an inclined surface 85*a* against which the selector jack is held, and since the butt 81 is still in engagement with the surface of the lowering cam 79, the selector is maintained under close control both in vertical and radial directions so as to prevent any possible wobble or vibration of the selector jack 32 in the slot 16 in the cylinder 15.

In the event that it is desired that the needle associated with the selector jack 32, which is entering the knitting station 11, not knit, the electromagnetic actuator or coil 80 which is associated with the selector jack is not energized. Therefore, the cam 70 is not moved into the position to engage the butt 60 on the selector jack 32. As a result, the selector jack is not pivoted inwardly radially of the cylinder 15 and the butt 56 on the selector jack 32 remains in the position illustrated at 32*c* and continues to move in that path. As a result, the butt 56 runs up the cam surface 57*a* of the cam 57 and the selector jack 32 is moved in a vertical direction.

The selector jack is shown in FIG. 4 in its position to which the cam 57 thereof raises the selector jack 32. When the cam 57 moves the selector jack 32 upwardly, it should be noted, from FIG. 1, that the take-down cam 79 has terminated and does not block any upward movement of the selector jack by the cam 57.

Moreover, it should be apparent that as the selector jack moves upwardly, the outer tip 90 of the portion 51 of the selector jack engages a surface 92 on the cam or block member 93 on which the take-down cam 79 is formed. The surface 92 is a tapered surface and tapers in a radially inward direction relative to the cylinder 15. When the outer tip of the member 51 engages the tapered surface 92, the tapered surface effects a camming of the member 51 radially inwardly of the cylinder 15. The portion 52 of the selector jack 32 is thereby moved into a recess or slot 95 formed in the cylinder 15 and is retained therein. This radially inward movement which is effected by the cam surface 92 causes a pivoting of the needle-moving jack 20 relative to the needle about its pivot connection 21 therewith. This results in the butt 25 of the jack 20 being moved out of the cam track 30. The vertical sliding movement of the selector jack 32 effects no vertical movement of the needle-moving jack 20, since the slot 50 enables relative sliding movement to be effected therebetween. Since the butt 25 of the needle-raising jack 20 is moved out of the cam path 30, the needle 17 is not raised and no knitting is effected thereby in that station.

The selector jack 32, when in the position shown in FIG. 4, is also maintained under control to minimize vibration and/or wobble thereof. When in this position, the portion 51 engages surface 79*b* of the cam 79 and tip 52*a* of portion 52 engages the bottom of the recess 95 to trap the upper end of the selector jack. The lower end thereof is trapped between the lug 85 and surface 57*b* of the cam 57, as shown. This restricts radial movement of the selector jack 32. The selector jack is also under control in a vertical direction due to the fact that the butt 81 thereon engages cam 79 and butt 56 engages cam 57.

The dotted line 100 in FIG. 1 designates a representative path of movement of the butt 56 on the selector jack 32, while the dotted line 101 designates the path of movement of the knitting needle 17 associated therewith. It should be apparent that a particular needle 17 knits in stations 11 and 13, if the needle-moving jack 20 associated therewith has been allowed to be maintained with the butt 25 thereof in the cam track 30. At station 12, the butt 25 is removed from the cam track and no knitting occurs. At station 14, the butt 25 remains in the cam track 30, but tucking occurs as described above.

In view of the fact that the butt 25 of the jack 20 is pivoted out of the cam track 30 when the needle associated with the jack 20 is to welt, this minimizes the possibility of the butts 25 breaking and causing a jam-up of the knitting machine 10. As a result, the knitting machine can be operated at an extremely high rate of speed.

Moreover, as should be apparent from the above, a selector jack 32 is moved by actuation of its associated coil 80 only when the needle associated therewith is to knit at a given station. Thus, if a needle is to welt in a station, the selector jack 32 associated therewith will pass through the station and not be acted upon therein by its associated coil 80 after being positioned by cam 55. If the needle also did not knit in the preceding station, then even the cam 55 does not act on the selector jack 32. As a result, a minimum of movements of the selector jack are necessary to make a selection. This adds to the speed at which the knitting machine may operate.

Figure 6:
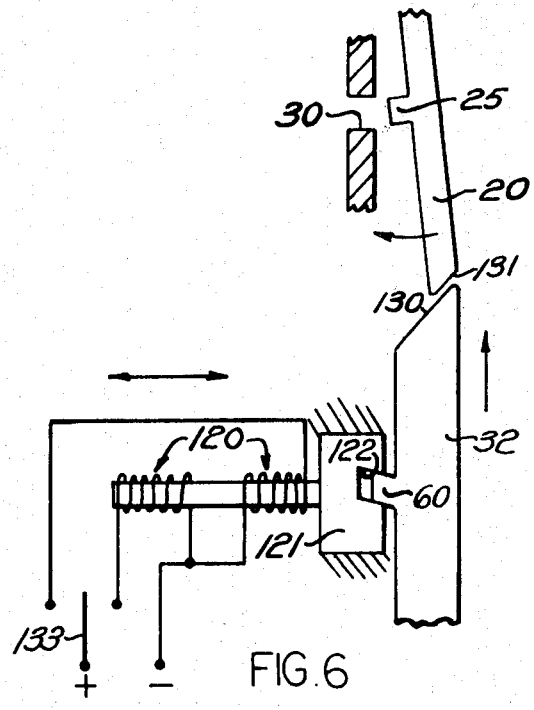
FIG. 6 is a schematic view of a modified embodiment of the present invention.

The embodiment of the present invention which is illustrated in FIG. 6 is similar to the embodiments shown and described in detail hereinabove, except for the electromagnetic means and cam arrangement for effecting the movement of the selector jacks 32. Accordingly, FIG. 6 illustrates only that mechanism which effects the vertical movement of the selector jacks 32.

As illustrated in FIG. 6, an electromagnetic means in the form of a coil means 120 is operatively associated with a cam member 121. The cam 121 has a cam slot 122 in which the butts 60 on the selector jack 32 move as the selector jacks are advanced therepast.

In order to effect the vertical actuation or movement of the selector jacks 32, the cam 121 is moved radially inward of the cylinder upon energization of the coil means 120 with the result being that the butt 60 is vertically raised due to the taper on the slot 122. The vertical raising movement of the selector, of course, then effects the pivoting movement of the jack 20 which results in the butt 25 thereof being moved into the cam slot 30 in the manner described hereinabove. In this embodiment, the pivoting of the needle-moving jack 20 into cam track 30 is effected by the reciprocating movement of the selector jack 32 without radial movement thereof. The jack 20 may be moved out of the cam track by any suitable means such as a fixed cam (not shown). Accordingly, the tapered surfaces 130, 131 which effect the pivoting of the jack 20 are located on the selector jack 32 and needle-raising jack 20, respectively. The cam 121 is moved radially outwardly by reversing the energization of the coil means 120 due to the operation of a suitable selector switch 133 which may be operated in any suitable manner in the proper timed relationship with the remainder of the knitting machine. When the cam 121 is moved radially outwardly, the selector jack 32 is lowered so as to be received in the cam 121 at the next station.

Figure 7:
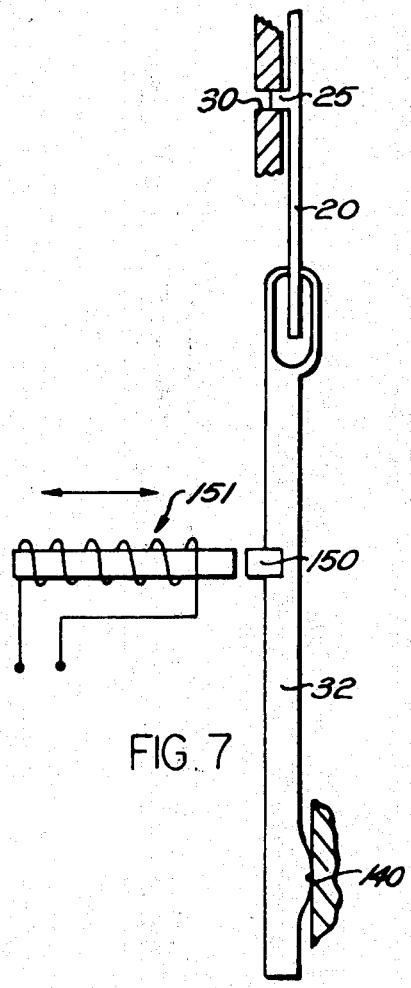
FIG. 7 is a view of a still further modified embodiment of the present invention.
Figure 8:
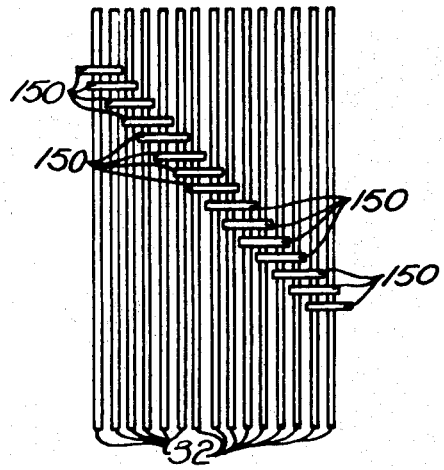
FIG. 8 is a schematic view of the embodiment of FIG. 7.
Figure 9:
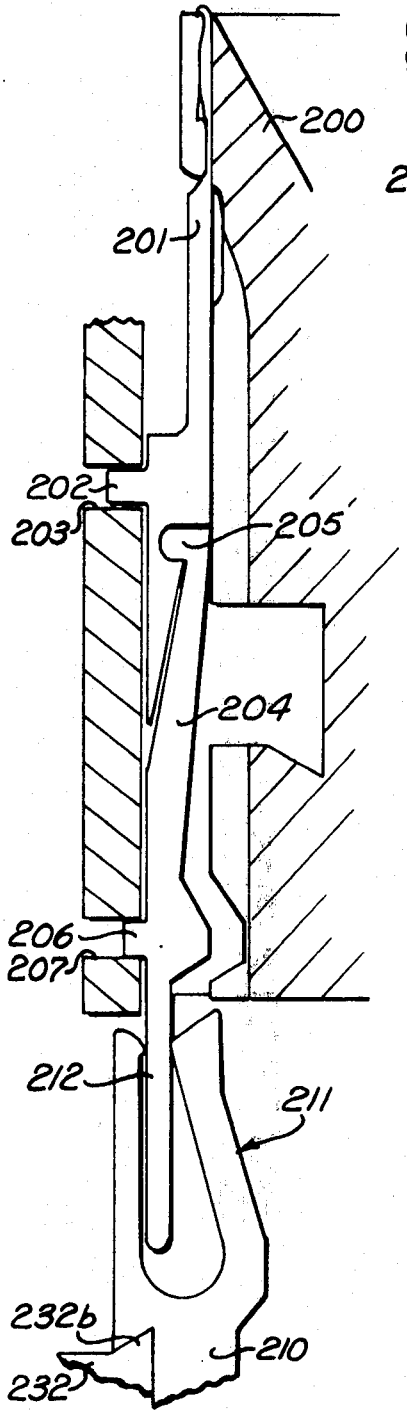
FIGS. 9 and 10 are schematic representations of portions of a circular knitting machine of modified construction.

The modification of the present invention which is illustrated in FIGS. 7 and 8 is also similar to that which is described hereinabove in connection with FIGS. 1–5. However, the electromagnetic mechanism and selector jack arrangements are of a somewhat different construction.

In the embodiment illustrated in FIGS. 7 and 8, the selector jacks 32 are mounted for pivotal movement about a pivot axis 140. Each selector jack 32 is associated with a needle-moving jack 20 to effect pivotal movement of the needle-moving jack radially of the needle-carrying cylinder upon pivoting of the selector jack 32. Accordingly, the control of the knitting needle is effected by radial pivoting movement of the selector jack 32 as opposed to reciprocating movement of the selector jack 32 as in the embodiments of FIGS. 1 and 6.

The pivoting of the selector jacks 32 is effected by a suitable control mechanism. This control mechanism includes permanent magnets 150 mounted on each selector jack. The permanent magnets 150, as best illustrated in FIG. 8, are arranged on the selector jacks in a vertically staggered relationship in much the same manner described above in connection with the butts 60 on the selector jacks 32 of the modification shown in FIG. 1. Electromagnetic means in the form of electromagnets 151 are arranged in a vertical manner at each station and are selectively energizable to attract the permanent magnets thereto and thereby position the butts 25 of the needle-moving jacks 20 in the cam track 30. The polarity of the electromagnets 151 can be reversed to repel the magnets 150 therefrom and in this manner move the butts 25 of the needle-moving jacks 20 out of the cam track 30 and thereby prevent knitting by the needle as it progresses through that particular station. In this manner, the selector jacks 32 are moved radially under the control of the electromagnets 151.

The embodiment of the present invention which is illustrated in FIGS. 9–14 has many of the common features described hereinabove in connection with the embodiments of FIGS. 1–8. In the embodiment of FIGS. 9–14, the knitting cylinder, designated 200, see FIG. 9, carries knitting needles 201 which have butts 202 thereon which move in a cam track 203, which cam track controls movement of the knitting needle. The needle-moving jacks 204 are pivotally connected at 205 with each knitting needle 201. The knitting needle-raising jacks 204 each have a butt 206 thereon which may be received in a cam track 207 defined by suitable cams located at each knitting station. When the butt 206 is received in the cam track 207, it effects knitting movement of the needle 201, as described in detail in connection with the embodiments of FIGS. 1–8. When the jack 204 is moved radially so that the butt 206 is out of the cam track 207, the needle is not moved by the action of the cam track 207 acting on the butt 206 of the needle-raising jack 204, and, accordingly, no knitting is effected thereby.

The butt 206 of the needle-raising jack 204 is moved from the cam track 207 by radial movement of a selector jack 210. Each needle-moving jack 204 has a selector jack 210 associated with it. Each selector jack 210 has an upper portion, generally designated 211, which is of a general U shape and receives between the legs of the U the tail end or lower end portion 212 of a selector jack 204. The connection between the portion 211 of each selector jack 204 and the tail portion 212 of the needle-raising jack is such as to enable relative reciprocating movement to occur between the needle-raising jack and the selector jack, this relative movement occurring in the direction parallel to the axis of the needle cylinder.

As noted hereinabove, radial movement of the selector jack 210 effects radial pivoting movement of the needle-moving jack 204 relative to its associated needle and thereby effects a control of the operation of the knitting needle 201. The selector jacks 210 are moved radially by operation of electromagnetic actuators 219. The selector jacks 210 are arranged in a series and each selector jack in the series has a butt 218 located thereon at a unique location in the series for purposes of selection by an electromagnetic actuator, as described in connection with FIGS. 1–3. The drawings do not illustrate all electromagnetic actuators, and this arrangement is similar to that described in detail in connection with the embodiment of FIGS. 1–3 and will not be repeated here. However, it should be understood that each actuator 219 includes an actuator member **219*a* (See FIG. 11) which is movable into the path of movement of the butt 218 of its associated selector jack 210 and, when moved into the path of movement of the selector jack butt 218, effects a radial movement of the selector jack 210** relative to the knitting cylinder.

Figure 14:
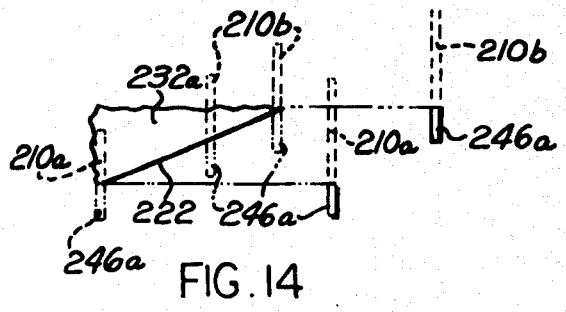
FIG. 14 is a view taken approximately along line 14-14 of FIG. 10.
Figures 11, 12, 13:
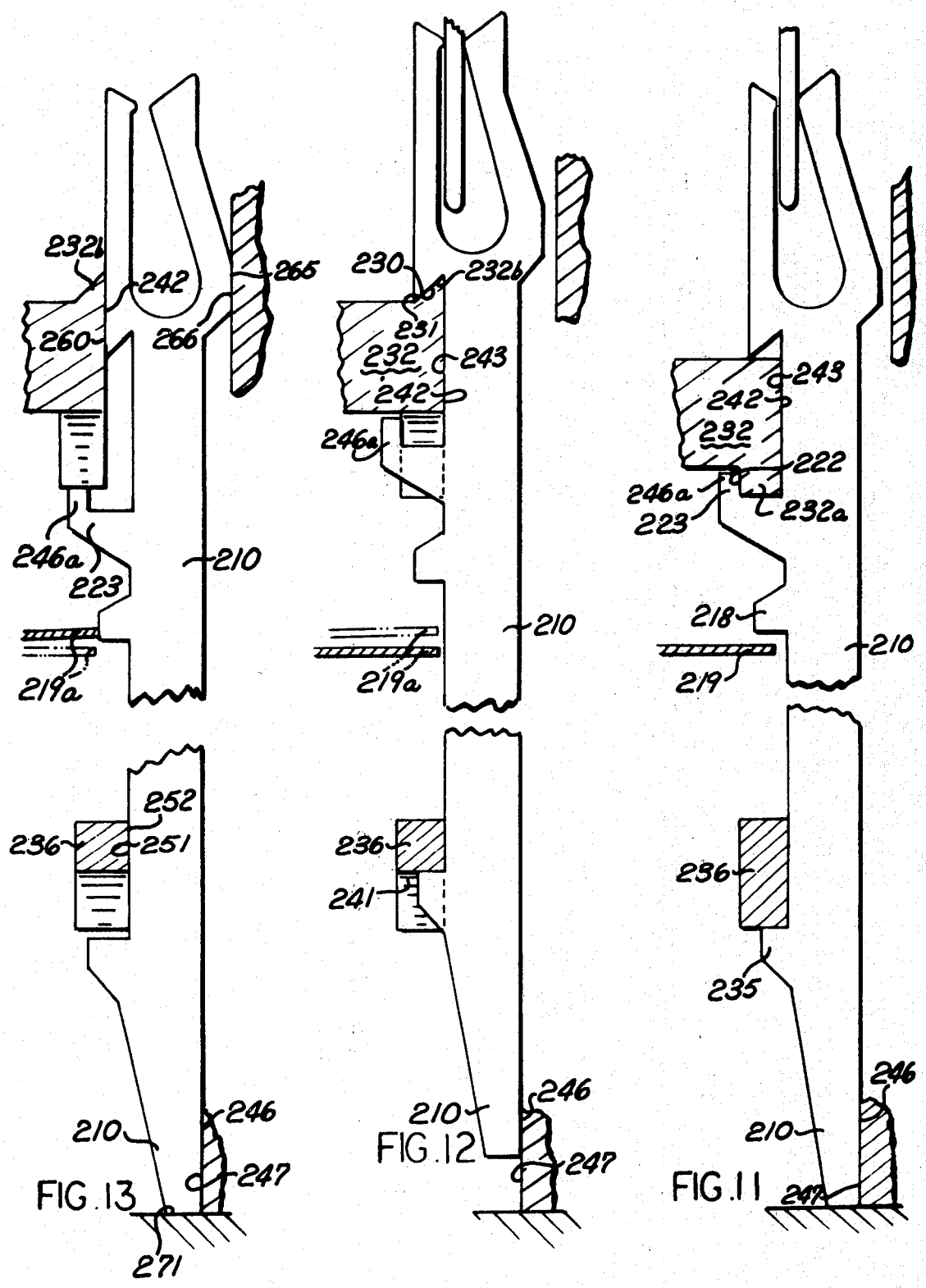
FIGS. 11–13 are sectional views taken on respective lines of FIG. 10 showing different operative positions of parts of the knitting machine of FIG. 1.

Each selector jack as it is leaving one knitting station is positioned in, what might be termed, a "basic" position, which is illustrated in FIG. 11. The selector jack is positioned in the basic position by the action of a cam projection **232*a* having a slanted cam surface 222, as shown in FIG. 14. The cam surface 222 acts on an L-shaped butt 223 of the selector jack and moves the selector jack radially of the cylinder and effects a positioning of the selector jack in the basic position illustrated in FIG. 11,** as will be described in greater detail below.

Figure 10:
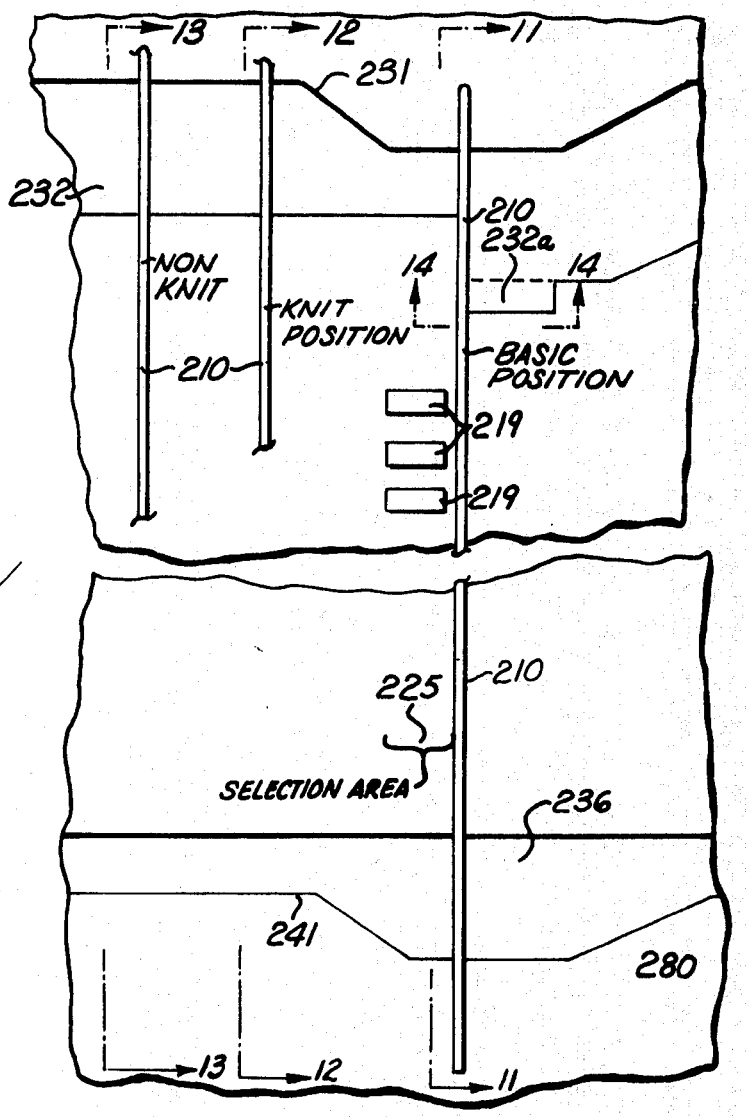

After the selector jack has been moved into its basic position, the selector jack moves into a location, generally designated 225 in FIG. 10, which may be termed an "actuating" or "selection" area. If a given needle is to be positioned for knitting, the selector jack 210 associated with the needle which is to knit is not moved radially of the cylinder, and as a result the actuator member **219*a* is not moved into a position to engage the butt 218** on the selector jack. Accordingly, the selector jack remains in the same radial position that it had when in its basic position.

The selector jack 210 is shown in FIG. 11 in its basic position wherein the L-shaped butt 223 on the selector jack 210 is located beneath the raising cam 232. Also in the position shown in FIG. 11, the lower end of the selector jack 210 has a butt 235 which is in engagement with a lowering cam 236 and the extreme lower end of the selector jack 210 engages a surface 247 of the knitting needle cylinder. As noted above, when the selector jack 210 is to effect knitting by its associated needle in a given station, the actuator 219 associated with that selector jack is not energized and, accordingly, the selector jack remains in the same radial position that it had when it was in its basic position as it moves through the station and knitting is effected.

The knit position of a given selector jack is illustrated in FIG. 12. As shown in FIG. 12, the selector jack 210 has been raised or, stated otherwise, moved in a direction parallel to the axis of rotation of the knitting needle cylinder from its basic position of FIG. 11. This movement is effected by the raising cam 232 and, specifically, by the surface 230 of the jack moving up the surface 231 of the raising cam. It should be apparent that the lower cam 236 has a cam surface 241 which is shaped so as not to interfere with the vertical reciprocating movement of the jack 210. Of course, this reciprocating movement effects no vertical or pivoting movement of the needle-moving jack 204 and, accordingly, the needle 201 is not effected by this raising movement of the selector jack 210.

When the selector jack 210 is in its basic position, as illustrated in FIG. 11, the selector jack is under complete control due to the fact that radially inner and outer surfaces on the selector jack are trapped between corresponding surfaces in the knitting machine. As best seen in FIG. 11, the raising cam 232 has a surface 242 which engages a surface 243 of the selector jack body. The surfaces 242, 243, of course, extend axially of the knitting cylinder and the engagement thereof prevents movement of the selector jack 210 radially of the cylinder. Moreover, the lower end of the selector jack 210 has the surface portion 246 which engages the surface portion 247 and these surfaces likewise extend axially of the knitting cylinder. These surfaces trap the selector jack 210 for proper control in a radial direction and prevent movement of the selector jack radially.

Moreover, when the selector jack 210 is in its basic position, the L-shaped butt 223 on the selector jack 210 has its outer leg 246*a* extending upwardly into engagement with surface 222 of the raising cam 232. As a result of this construction, a portion 232*a* of the raising cam 232 is trapped between the leg 246*a* of the L-shaped butt 223 and the main body of the selector jack 210. This also limits the movement of the jack in the radial direction.

It should be apparent that, when a selector jack 210 is in its knitting position, as seen in FIG. 12, it again is trapped or limited in a radial direction, as well as in an axial direction. Insofar as the radial direction is concerned, the surface 246 engages surface 247 to limit radial movement to the right, in FIG. 12, and surfaces 243, 242 are engaged to limit radial movement to the left. Moreover, the construction of the raising cam 232 which includes the triangular-shaped projection 232*b* which extends into a corresponding recess in the selector jack 210 also limits radial movement of the selector jack 210 when it is in its radial position. It should be noted that the projection 232*b* does not extend so as to contact the selector jack 232 when in its basic position. Specifically, the triangular projection 232*b* on the cam 232 is in the corresponding recess in the jack and further limits the radial movement of the selector jack 210, when the selector jack is in the position illustrated in FIG. 12.

It should also be apparent that axial movement of the selector jack 210 is also limited by and controlled by the cams 232 and 236 which engage surfaces of the jack 210 and are constructed to continuously engage the respective jack surfaces as the jack 210 moves through the knitting station and knitting is effected by the associated needle.

In the event that a given needle associated with the selector jack 210 is not to knit in the station in which it is entering, the actuator which is associated with that selector jack 210 is operated in order to effect radial movement of the selector jack 210 from its radial position illustrated in FIG. 11 to its radial position illustrated in FIG. 13. This radial movement is effected by movement of the actuator member 219*a* associated with a particular selector jack 210, as noted above. If the actuator member associated with that selector jack is energized, the butt 218 on the selector jack 210 engages the actuator member 219*a* and, as a result, the selector jack is cammed radially toward the right, as viewed in FIG. 11. This camming action occurs in the selection area immediately after the leg 246*a* of the selector jack 210 moves beyond cam projection 232*a.* The surfaces 247 and 252 may have to be shaped and to accommodate this radial movement and maintain contact with the selector jacks.

As a result of this radial camming action, the surface 230 of the selector jack 210 is moved radially so as not to engage the surface 231 of the raising cam 232. As a result, the selector jack 210 is not moved vertically and is not raised by the raising cam 232. However, the radial movement thereof effects through the connection 211 a pivoting action of the needle-moving jack 204 so that the butt 206 thereon will not be located in the cam track 207. As a result, movement of the needle through the station will be effected without any raising movement of the knitting needle and, acordingly, no knitting by the needle will occur in the knitting station.

It should be apparent, however, that even though the selector jack 210 has been moved to a non-knit position, the selector jack 210 is trapped and under control in the knitting needle cylinder. In this position, the selector jack 210 has a surface 260 which engages the surface 242 of the raising cam to block movement of the selector jack radially of the knitting cylinder toward the left, as viewed in FIG. 13. Likewise, a surface portion 251 of the selector jack engages a surface 252 of the cam 236, which also prevents movement of the selector jack radially of the knitting cylinder toward the left, as viewed in FIG. 13. The selector jack is prevented from moving toward the right, as viewed in FIG. 13, by engagement of surface 265 thereof with surface 266 and by engagement of surfaces 246, 247. As a result, it should be apparent that the selector jack, even though in a non-knitting position, is trapped from movement in a radial direction relative to the needle cylinder. The selector jack, likewise, is trapped from downward longitudinal movement relative to the knitting needle cylinder due to the fact that the lower end of the selector jack 210 is in engagement with the lower end surface 271 of the slot in which it is received, thereby blocking movement in a downward direction, as viewed in FIG. 13. Accordingly, it should be apparent that, even though the selector jack 210 is in its non-knit position, FIG. 13, movement of the selector jack radially of the knitting cylinder is blocked in a positive manner, thereby maintaining the selector jack under positive control at all times. As the selector jack 210 leaves the knitting station, it is moved downwardly, if it had been reciprocated upwardly, by the lowering cam 236 and, specifically, by the surface 280 of the lowering cam 236, as best shown in FIG. 10.

As noted hereinabove, the cam projection 232*a* is effective to position the selector jacks 210 in the basic position prior to selection at the next knitting station as the selector jack leaves the previous knitting station and after it passes beyond lowering surface 280 of the lowering cam 236. If a given selector jack was in its knit position as it traversed through the previous station, the cam surface 222 would not engage the butt 223 of the selector jack, and the selector jack 210*a*, as illlustrated in FIG. 14, is in such a position. Accordingly, the leg 246*a* of this particular selector jack would not be acted upon by the cam projection 232*a* . However, selector jack 210*b*, as illustrated in FIG. 13, was in its non-knit position as it traversed through the knitting station and, accordingly, the leg 246*a* of the selector jack will run into or engage the cam surface 222 of the cam projection 232*a*, which will then effect a radial movement of the selector jack from the position in which it is located when non-knitting to the radial position illustrated in its basic position prior to entry into the next knitting station. The dotted positions in FIG. 14 depict the movement of the selector jacks 210 relative to cam projection 232*a*.

What is claimed is:

1. In an electromagnetic actuator assembly for selecting needles at a single knitting station in a circular knitting machine, said actuator assembly including a plurality of individual electromagnetic mechanisms each having a swingable armature movable between a first position, in which the armature is ineffective to move needle selector jacks, and a second position, in which the armature is effective to move the jacks, and an electric coil energizable to create a magnetic force to attract the armature to the second position, the improvement wherein:

a. each armature of each electromagnetic mechanism comprises a substantially flat member having a distal end engageable with needle selector jacks when in said second position and having a proximal end disposed generally radially outwardly of the machine from said distal end, each said armature being pivotal at said proximal end about horizontal axis pivot means between the first and second positions, b. each electric coil of each electromagnetic mechanism includes an internal core, said core being generally located between said distal and proximal ends of the armature when the armature is in said second position such that the magnetic force attracts the armature between said distal and proximal ends, c. a frame supports each electromagnetic mechanism in fixed position and provides said horizontal axis pivot means for the armature, d. each coil, core and armature of each electromagnetic mechanism have co-planar axes, e. the said co-planar axes of the several electromagnetic mechanisms all being disposed in a single vertical plane, whereby the plurality of individual electromagnetic mechanisms are all arranged in a single vertical column at the knitting station, and f. a spring, opposing movement of the armature to the second position, is disposed intermediate the armature and the core of the electrical coil of each electromagnetic mechanism, when the armature is in the first position.

2. An electromagnetic actuator assembly according to claim 1, wherein the spring of each electromagnetic mechanism extends vertically relative to the armature and the core, and biases the armature toward the first position.

3. An electromagnetic actuator assembly according to claim 1, wherein a. the frame of each electromagnetic mechanism includes a portion extending through and emerging from the coil, b. a segment of the frame portion disposed internally of the coil provides the core for the coil, c. the portion of the frame emerging from the coil provides support means for the spring, and d. the spring extends from the emerging portion of the frame transversely of the core in the direction of the armature.

4. An electromagnetic actuator assembly according to claim 3, wherein the spring is a vertical axis coil spring biasing the armature toward the first position.

5. An electromagnetic actuator assembly according to claim 1, wherein a. the knitting machine is provided with a plurality of groups of individual needle selector jacks, b. each jack of each group of jacks includes a jack butt, c. the butts of the jacks of each group of jacks being disposed in separate horizontal planes, d. each armature of each individual electromagnetic mechanism, when in its second position, is disposed in the horizontal plane of one only of the jack butts in each group of jacks, e. the number of individual electromagnetic mechanisms in the actuator assembly is at least as great as the number of jack butts in each group of jacks, and f. each armature of each individual electromagnetic mechanism is a cam member for engaging its associated jack butt.

* * * * *

UNITED STATES PATENT OFFICE

CERTIFICATE OF CORRECTION

PATENT NO. : 3,990,270

DATED : November 9, 1976

INVENTOR(S) : Horst Paepke

It is certified that error appears in the above-identified patent and that said Letters Patent are hereby corrected as shown below:

Column 5, line 12, after "has" insert --a--

Column 5, line 26, change "76", second occurrence, to --75--

Signed and Sealed this

First Day of February 1977

[SEAL]

*Attest:*

RUTH C. MASON
*Attesting Officer*

C. MARSHALL DANN
*Commissioner of Patents and Trademarks*